US007037213B2

(12) United States Patent
Otoguro

(10) Patent No.: US 7,037,213 B2
(45) Date of Patent: May 2, 2006

(54) GOLF CLUB HEAD

(75) Inventor: Masaaki Otoguro, Shizuoka-ken (JP)

(73) Assignee: Peparlet Co. Ltd., Shizuoka-Ken (JP)

( * ) Notice: Subject to any disclaimer, the term of this patent is extended or adjusted under 35 U.S.C. 154(b) by 0 days.

(21) Appl. No.: 10/839,280

(22) Filed: May 6, 2004

(65) Prior Publication Data

US 2005/0143192 A1 Jun. 30, 2005

(30) Foreign Application Priority Data

Dec. 26, 2003 (JP) ..... 2003-432836

(51) Int. Cl.
*A63B 53/04* (2006.01)
*A63B 53/06* (2006.01)

(52) U.S. Cl. ..... 473/333; 473/336; 473/337; 473/326

(58) Field of Classification Search ..... 473/333–339, 473/349–350, 326
See application file for complete search history.

(56) References Cited

U.S. PATENT DOCUMENTS 4,340,230 A * 7/1982 Churchward ..... 473/339
4,655,459 A * 4/1987 Antonious ..... 473/338
4,811,949 A * 3/1989 Kobayashi ..... 473/337
4,869,507 A * 9/1989 Sahm ..... 473/337
5,082,279 A * 1/1992 Hull et al. ..... 473/242
5,385,348 A * 1/1995 Wargo ..... 473/338
5,613,916 A * 3/1997 Sommer ..... 473/332
6,149,533 A * 11/2000 Finn ..... 473/336
2002/0137576 A1* 9/2002 Dammen ..... 473/336

FOREIGN PATENT DOCUMENTS

JP 8-155059 6/1996

* cited by examiner

*Primary Examiner*—Sebastiano Passaniti
(74) *Attorney, Agent, or Firm*—Wenderoth, Lind & Ponack, L.L.P.

(57) ABSTRACT

The present invention provides a golf club head, in which a stable high-inertia moment is generated at the time of down swinging and impacting of a golf club, thereby reliably achieving the effect of increase in driving distance. A golf club head has a plurality of hollow chambers 3 arranged in mutually parallel relation and in mutually adjacent relation within a head 1 from a heel 6 toward a toe 7. Each hollow chamber 3 is faced with a sole-forming wall. A weight 9 composed of a granular body or liquid body is sealed in each of the hollow chambers 3, and each of the hollow chambers 3 is provided with an openable and closable inlet/outlet port 8 for charging the weight 9 into each of the hollow chambers 3.

4 Claims, 3 Drawing Sheets

GOLF CLUB HEAD

FIELD OF THE INVENTION

The present invention relates to a golf club head in which a stable high-inertia moment is generated to the entire head at the time of swinging of the golf club.

BACKGROUND ART

Patent Document 1 discloses a golf club head, in which a metal granular body is sealed in the golf club head such that the metal granular body is concentrated on a central part (position opposing a sweet spot of a face plate) of a rear part of the head at the time of swinging of a golf club and the metal granular body is collided with the sweet spot of the face plate at the moment the club head impacts a golf ball, so that a rebounding force of the face plate is enhanced to thereby increase the driving distance.

[Patent Document 1] Official Gazette of Japanese Patent Application Laid-Open No. H08-155059

SUMMARY OF THE INVENTION

[Problem to be Solved by the Invention]

The conventional example mentioned under the Background Art is obviously designed such that the metal granular body is concentrated on the central part of the rear end of the head at the time of swinging so that the metal granular body will be concentrated on and collided with the sweet spot at the time of impacting. However, this conventional golf club head has such shortcomings that the metal granular body is liable to offset the rebounding force of the face plate by rendering an opposite force to the face plate which tends to flex inward, and the metal granular body is liable to spoil the stable swinging because the granular body is scattered toward the face plate.

Moreover, the above-mentioned conventional example is obviously designed such that the metal granular body is arranged at the central part of the head so as to generate a colliding force for the metal granular body against the sweet spot. However, it has such a problem that a high-inertia moment is difficult to obtain because the metal granular body is scattered at the central part of the head.

[Means for Solving the Problem]

The present invention provides a golf club head, in which a stable high-inertia moment is rendered to a golf club head, and increase in head speed or driving distance can be expected without causing any external disturbance to the sweet spot of the face plate or the entire head, and which has a low gravity so as to enable effective adjusting of the weight according to individual differences of golfers.

This golf club head is constructed such that a plurality of hollow chambers are arranged in mutually parallel relation and in mutually adjacent relation within a head from a heel toward a toe, each hollow chamber being faced with a sole-forming wall, a weight composed of a granular body or liquid body being sealed in each of the hollow chambers, and each of the hollow chambers being provided with an openable and closable inlet/outlet port for charging the weight into each of the hollow chambers.

[Effect of the Invention]

The behavior of the weight composed of the granular body or liquid body at the time of impact is limited to the inside of each hollow chamber and also limited to the bottom region facing the sole-forming wall which is most distant from the grip of the club shaft, and a stable high-inertia moment is generated at the time of swinging and impacting, thus enabling reliable achievement of the intended effect of increasing driving distance.

Moreover, since the weight composed of the granular body or liquid body is disposed in the individual hollow chambers arranged in parallel from the heel toward the toe, stable winging of the entire head is ensured, the effect of increase in the above-mentioned inertia moment can be obtained, and a gear effect can be expected in which a force for turning the head at the time of failing to strike the ball is restrained, thus reducing the frequency of occurrence of missed shots as much as possible.

DETAILED DESCRIPTION OF THE INVENTION

Figure 1:
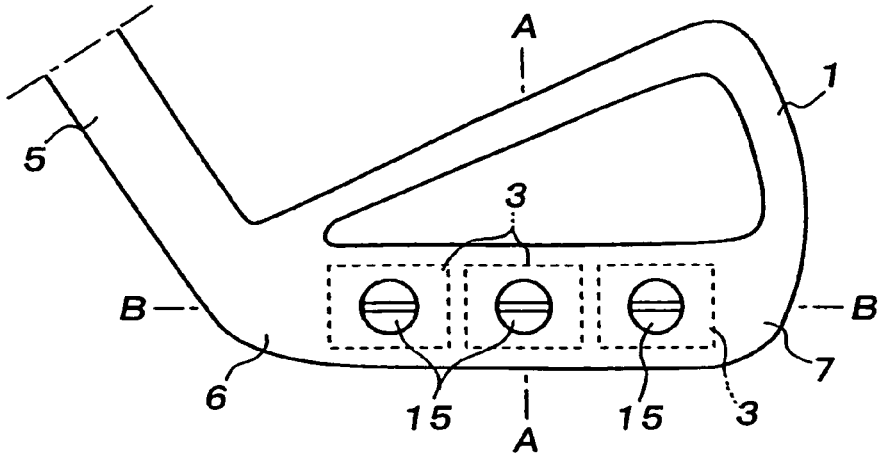
FIG. 1 is a rear view of an iron club, as an example in which a plurality of hollow chambers, each having a weight composed of a granular body or liquid body sealed therein, are arranged in parallel at a bottom part of a golf club head.
Figure 2:
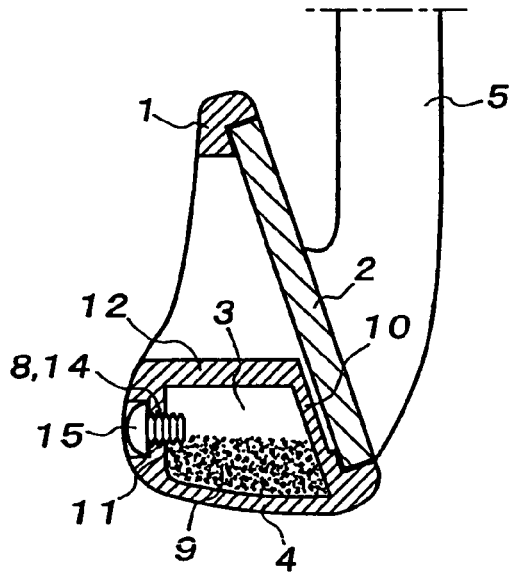
FIG. 2 is a sectional view taken on line A—A of FIG. 1.
Figure 3:
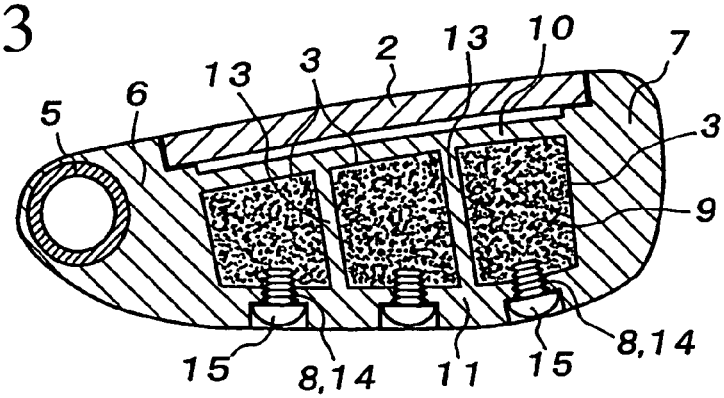
FIG. 3 is a sectional view taken on line B—B of FIG. 1.

A preferred embodiment of the invention will be described hereinafter with reference to FIGS. 1 through 7. It should be noted that although those Figures show an iron club, the present invention is applicable to gold clubs consisting of an iron club and a wood club.

As shown in FIGS. 1 through 5, as means for adjusting the weight of the head by sealing a weight 9 composed of a granular body or liquid body in a golf club head 1, a plurality of hollow chambers are arranged in mutually parallel relation and in mutually adjacent relation from a heel 6 toward a toe 7 within the head 1, and the hollow chambers 3 are faced with a sole-forming wall 4.

Each hollow chamber 3 is defined by the sole-forming wall 4, a front wall 10 raised from the sole-forming wall 4 and located at the inner side of a face plate 2, a rear wall 11 continuous with an end of the sole-forming wall 4 of the head 1, an upper wall 12 located between the front wall 10 and the rear wall 11 and arranged in opposing relation to the sole forming wall 4, and a partition wall 13.

That is, the respective hollow chambers 3 are positionally restrictively disposed at a bottom part of the head 1 which is the most distant part from a grip, and they are arranged in mutually parallel relation and in mutually adjacent relation from the heel 6 toward the toe 7. Preferably, the weight 9 is placed in such a manner as not to interfere with the face plate 2.

The weight 9 composed of the granular body or liquid body is sealed in each hollow chamber 3 with play, and each hollow chamber 3 is provided with an inlet/outlet port 8 capable of opening and closing the chamber 3, so that the amount of the weight 9 to be sealed in the hollow chamber 3 can be adjusted in accordance with differences of individual golfers.

The inlet/outlet port 8 is provided to each hollow chamber 3. As one example, as shown in FIGS. 1 through 5, the respective inlet/outlet ports 8 are arranged in parallel relation at the rear wall 11 of the golf club head 1.

In FIGS, 1, 2 and 3, each inlet/outlet port 8 is composed of an internally threaded hole 14, and as means for opening and closing the inlet/outlet port 8, the internally threaded hole 14 is closed with an opening/closing plug composed of a headed male thread and the inlet/outlet port 8 is opened by releasing the headed male thread (male threaded member having a head) 15 and a suitable amount of the weight 9 is charged into or extracted from each hollow chamber 3 with a space so that the weight can properly be adjusted.

It is an interesting alternative that the headed male thread 15 is threadingly engaged with the internally threaded hole 14 to close the inlet/outlet port 8 so that the weight 9 can be sealed in each hollow chamber 3.

Figure 4:
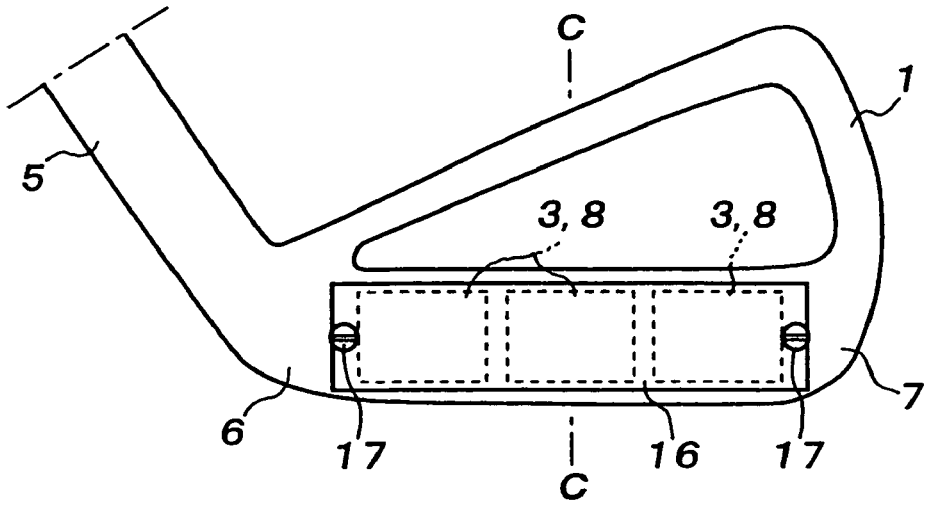
FIG. 4 is a rear view of a golf club head, showing an example in which inlet/outlet ports of the respective hollow chambers are closed with a single opening/closing cover.
Figure 5:
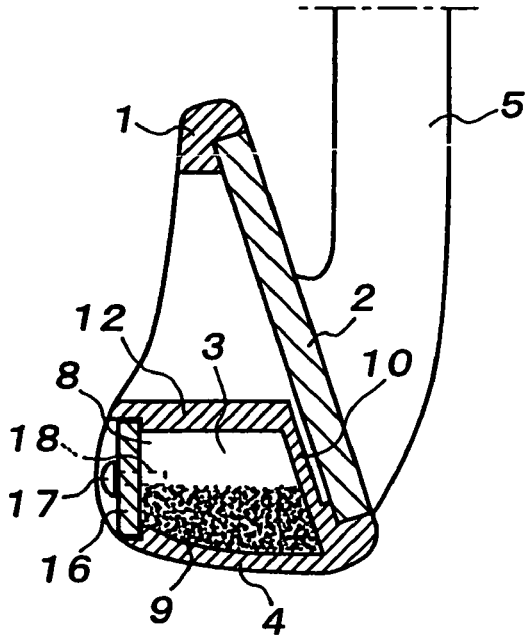
FIG. 5 is a sectional view taken on line C—C of FIG. 4.
Figure 6:
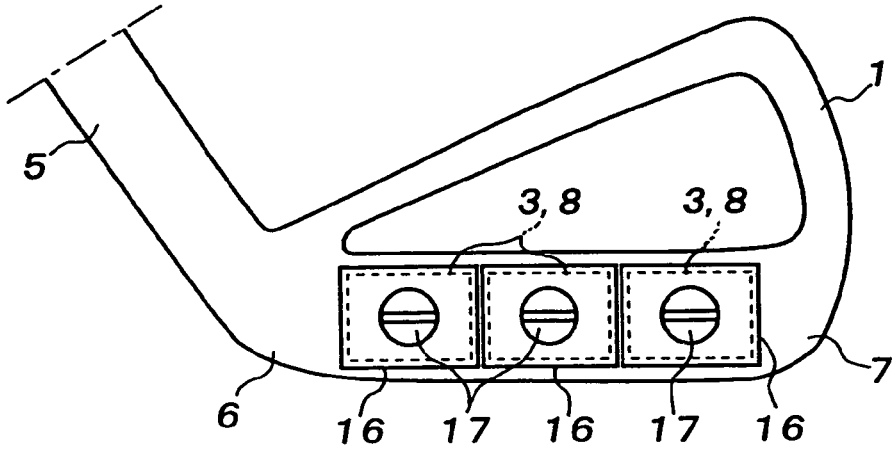
FIG. 6 is a rear view of a golf club head showing an example in which an inlet/outlet port of each hollow chamber is closed with an individual opening/closing cover.

It is also an interesting alternative that as means for opening and closing the inlet/outlet port 8, as shown in FIGS. 4 through 6, each hollow chamber 3 is open at its rear end face so that the inlet/outlet port 8 can be formed. Each inlet/outlet port 8 is closed with an opening/closing cover 16.

As one example, as shown in FIGS. 4 and 5, the inlet/outlet ports 8 are all closed with a single opening/closing cover 16, and the ports 8 are all opened by releasing the opening/closing cover 16, so that the weight 9 can be charged into and extracted from each hollow chamber 3.

As another example, as shown in FIG. 6, the inlet/outlet ports 8 of the respective hollow chambers 3 are closed with the individual opening/closing covers 16, and the weights 9 can individually be charged into and extracted from the respective hollow chambers 3 through the inlet/outlet ports 8 by individually releasing the opening/closing covers 16.

Each opening/closing cover 16 is tightened to the head 1 by using a male thread (mail threaded member) 17 so that each hollow chamber 3 can be closed. An internally threaded hole 18 with which the male thread 17 is to be threadingly engaged is formed in the defining wall of each hollow chamber 3.

As the weight 9 of a granular body, metal having a large specific gravity, for example metal granular body such as tungsten and molybdenum, or resin having a large specific gravity is employed. Similarly, as the weight 9 of a liquid body, oil or the like is employed.

Figure 7:
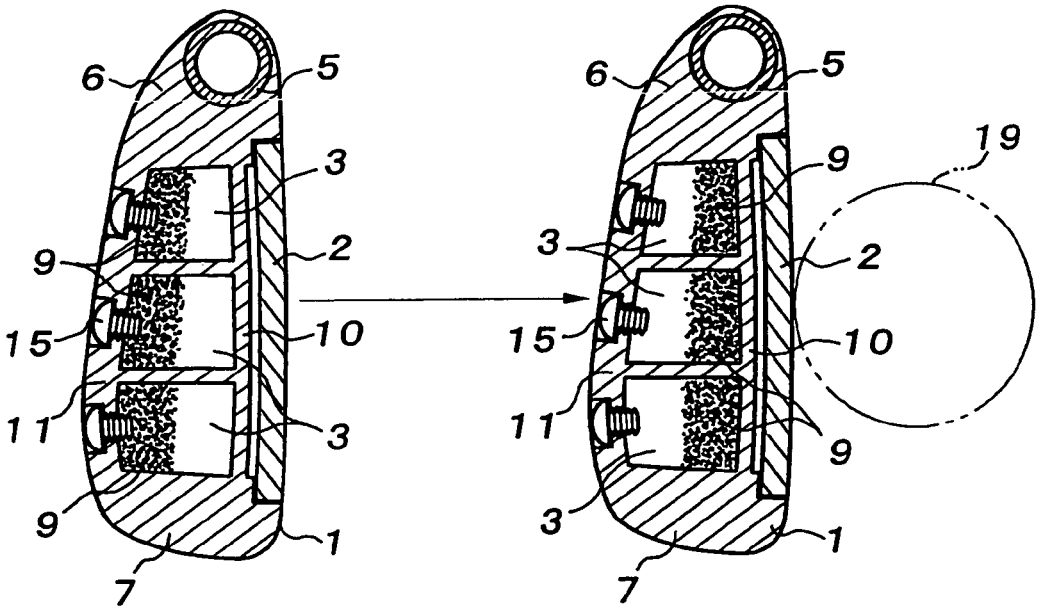
FIG. 7 is a cross-sectional view of the hollow chambers for explaining behavior of each weight during a downswing and at the time of impact of a golf club.

As shown in FIG. 7, in the process of down swinging from top to impact at the time of swinging of a golf club, the weight 9 composed of a granular body or liquid body is pressed against the rear wall 11 of each hollow chamber 3 by a centrifugal force and at the same time, it generates a stable high-inertia moment from the heel 6 toward the toe 7 of the head 1 to increase the head speed. At the time of impact, the weight 9 pressed against the rear wall 1 is pushed forward by inertia so as to be impactingly collided with the front wall 10, thereby further increasing the impact force caused by the head speed. Thus, there can be achieved the increase in driving distance.

The weight 9 composed of a granular body or liquid body is restricted to the bottom part of the head and its behavior is restricted to the inside of the respective hollow chambers 3 which are arranged in mutually parallel relation from the heel 6 toward the toe 7. Thus, stable swinging without any unfavorable accidental swaying can be enjoyed, and the flight direction of the ball 19 can be stabilized.

What is claimed is:

1. A golf club head characterized in that a plurality of hollow chambers are arranged in mutually parallel relation and in mutually adjacent relation within a head from a heel toward a toe, a weight composed of a granular body or liquid body being sealed in each of said hollow chambers, and each of said hollow chambers being provided with an openable and closable inlet/outlet port for charging said weight into each of said hollow chambers;

wherein said hollow chambers are defined between heel and toe portions by a bottom sole-forming wall, an upper wall, a front wall, a rear wall and at least one partition wall extending from said front wall to said rear wall; and wherein a face plate separate from said front wall is provided forward of said front wall.

2. A golf club head according to claim 1, wherein a space is formed between said front wall and said face plate.

3. A golf club head according to claim 1, wherein said weight is composed of the granular body.

4. A golf club head according to claim 1, wherein said weight is composed of the liquid body.

* * * * *